United States Patent [19]

Nelson et al.

[11] 4,350,267

[45] Sep. 21, 1982

[54] PORTABLE MODULAR BEVERAGE DISPENSER

[76] Inventors: Richard E. Nelson, 53 E. Tacoma, Clawson, Mich. 48017; Thomas J. Starr, 31409 Mound Rd., Apt. F, Warren, Mich. 48092

[21] Appl. No.: 106,929

[22] Filed: Dec. 26, 1979

[51] Int. Cl.[3] ..... B67D 1/04

[52] U.S. Cl. ..... 222/131; 62/389; 222/398; 222/399

[58] Field of Search ..... 222/131, 146 C, 183, 222/400.7, 399, 527, 526, 537, 530, 379, 398; 62/389, 457; 239/281; 220/8

[56] References Cited

U.S. PATENT DOCUMENTS

| | | | |
|---|---|---|---|
| 516,196 | 3/1894 | Gibson . | |
| 1,663,683 | 3/1928 | Doughty . | |
| 1,682,385 | 8/1928 | Leibing . | |
| 1,936,848 | 11/1933 | Masury | 222/131 X |
| 2,063,171 | 12/1936 | Kucher | 222/183 X |
| 2,090,403 | 8/1937 | Murray et al. | 222/183 X |
| 2,130,515 | 9/1938 | Tanner . | |
| 2,250,438 | 7/1941 | Persons . | |
| 2,259,852 | 10/1941 | Hall . | |
| 2,774,229 | 12/1956 | Thau et al. . | |
| 3,232,491 | 2/1966 | Hunt | 222/154 |
| 3,310,953 | 3/1967 | Rait | 62/389 X |
| 3,712,514 | 1/1973 | LeBlanc | 222/146 C |
| 3,790,032 | 2/1974 | George | 222/146 C |
| 3,915,382 | 10/1975 | Davis | 239/281 X |
| 4,164,853 | 8/1979 | McDonough | 62/389 X |

*Primary Examiner*—F. J. Bartuska

*Attorney, Agent, or Firm*—Basile, Weintraub & Hanlon

[57] ABSTRACT

A portable modular insulated beverage dispenser is disclosed. The beverage dispenser of the present invention comprises a base module including a refrigeration unit; a central sleeve module concentrically engageable with the base having a central bore configured to encircle a beverage container; and a cover module concentrically engageable with the sleeve to enclose the container. The cover includes a container of pressurized gas, a pressure regulator, a shut-off valve interposed the regulator and gas container, a tapping head including a gas inlet for applying regulated gas to the beverage container and a beverage outlet for dispensing beverage. A dispensing tower which includes a hand operated shut-off valve is provided and a gas conduit extends between the regulator and the gas inlet. A beverage conduit extends between the beverage outlet and the dispensing tower.

2 Claims, 8 Drawing Figures

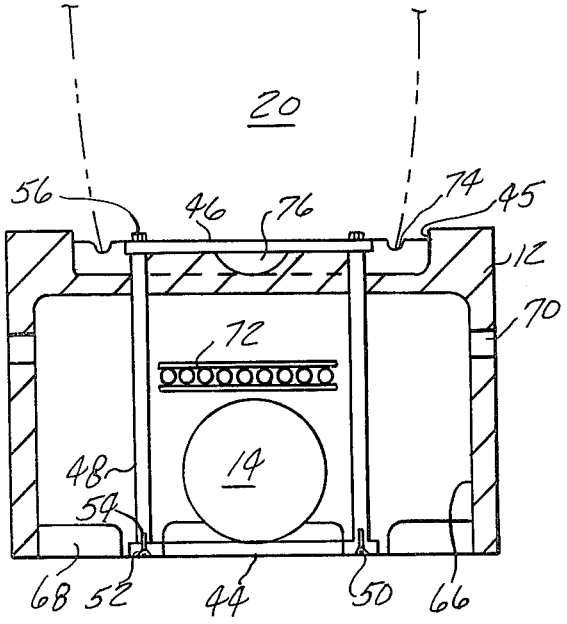
FIG-3
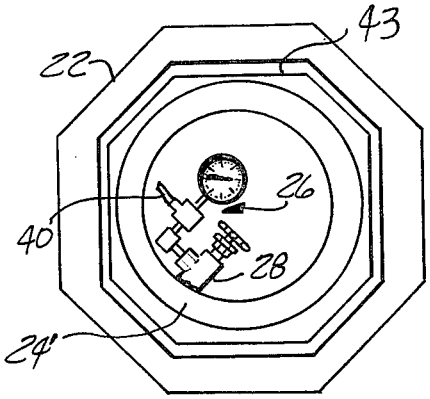
FIG-4
FIG-5
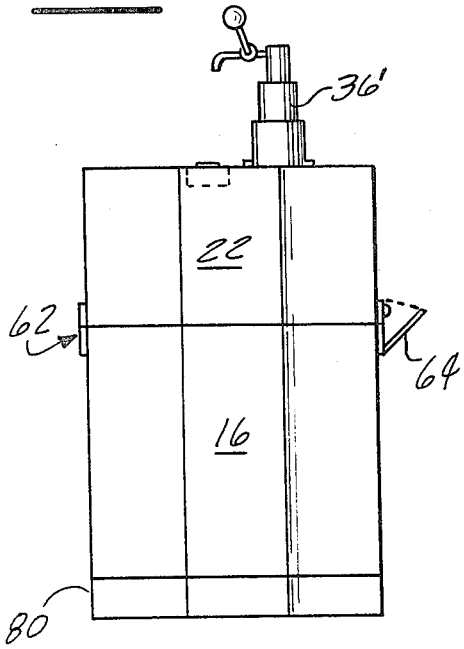
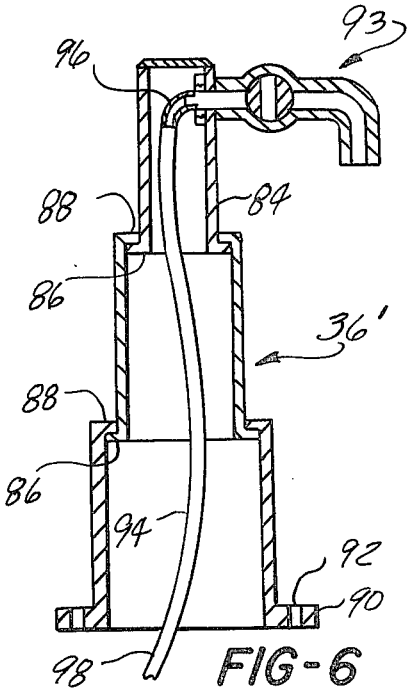
FIG-6

PORTABLE MODULAR BEVERAGE DISPENSER

CROSS REFERENCE TO RELATED APPLICATIONS

This application is related to co-pending application Ser. No. 137,983, Filed Apr. 7, 1980, entitled "TOROIDAL PRESSURE VESSEL". The present invention, as will be described subsequently, is adapted to selectively employ the "TOROIDAL PRESSURE VESSEL" of the co-pending application.

BACKGROUND OF THE INVENTION

I. Field of the Invention

The present invention generally relates to beverage coolers and, in and particular, the present invention is concerned with dispensing beverage coolers. Even more specifically the present invention is related to portable dispensing beer coolers which include a refrigeration unit and a pressurized gas container for providing pressure for dispensing the beverage.

II. Description of the Prior Art

Beverage coolers that are not portable are known. Generally these beverage coolers include a refrigeration unit for cooling the beverage, and a means for installing a fresh container of beverage when a prior container has been exhausted. U.S. Pat. Nos. 516,196; 1,663,683; 1,682,385; 2,130,515; 2,259,852; and 2,774,229 are represented of beverage coolers of this type.

U.S. Pat. Nos. 2,250,438; 2,259,852; and 2,774,229 illustrate beer coolers for cooling a container of beer and a tapping apparatus for withdrawing beer from the container. The above United States Patents all disclose a hinged door wherein the container is loaded into the cooler through a side top or front opening.

U.S. Pat. Nos. 2,259,852 and 2,774,229 disclose a source of gas under pressure applied to the beverage container for aiding in dispensing the beverage.

None of the above listed United States Patents disclose the three piece portable beverage dispenser of the present invention.

PRIOR ART STATEMENT

The aforementioned Prior Art in the opinion of the Applicants and the Applicants Attorney represents the closest prior art of which the Applicants and their Attorney are aware.

SUMMARY OF THE INVENTION

The present invention, which will be described in greater detail hereinafter, comprises a portable modular insulated container which may include a refrigeration unit for storing, transporting, and/or dispensing beverages or other perishable items such as whole blood. In a preferred embodiment the container includes a base module which may contain a refrigeration unit; a central sleeve module concentrically engageable with the base which includes a central bore configured to encircle a beverage container; and a cover module concentrically engageable with the sleeve to enclose the container. The cover module optionally includes a container of pressurized gas, a pressure regulator, a shut-off valve interposed the regulator and the gas container, and a tapping head which includes a gas inlet for applying regulated gas pressure to the beverage container and a beverage outlet for dispensing beverage from the container. A dispensing tower is affixed to the cover and includes a hand operated shut-off valve. A gas conduit extends between the regulator and the gas inlet and a beverage conduit extends between the beverage outlet and the dispensing tower.

It is therefore a primary object of the present invention to provide a new and improved portable insulated container.

It is a further object of the present invention to provide a portable insulated container with an integral refrigeration unit.

It is yet another object of the present invention to provide a portable insulated container with an integral refrigeration unit that has a source of pressurized gas to aid in dispensing carbonated beverages.

It is yet another object of the present invention to provide a portable insulated container including an integral refrigeration unit and having a source of pressurized gas to aid in dispensing carbonated beverages which includes a telescoping beverage dispenser for compact storage and transportation.

It is yet a further object of the present invention to provide a portable insulated refrigerated container for dispensing beverages that is energy efficient and inexpensive to operate.

It is another object of the present invention to provide a portable insulated container that can be made from molded urethane foam to form a durable inexpensive structure.

Further objects, advantages, and applications of the present invention will become apparent to those skilled in the art to which this invention pertains, when the accompanying description of one example of the best mode contemplated for practicing the invention is read in conjunction with the accompanying drawing.

BRIEF DESCRIPTION OF THE DRAWING

In the drawing like reference numbers refer to like parts throughout the several views, and wherein:

FIG. 3 represents a cross sectional view through the lines 3—3 of FIG. 1;

FIG. 4 illustrates a bottom view of a cover module employing a toroidal pressure vessel;

FIG. 5 illustrates a side view of another embodiment of a portable beverage dispenser with an insulated bottom replacing the refrigeration unit of FIG. 1;

FIG. 6 illustrates a cross-sectional view of the telescoping beverage dispensing tower taken along the lines 6—6 of FIG. 1.

DESCRIPTION OF THE PREFERRED EMBODIMENT

Figure 1:
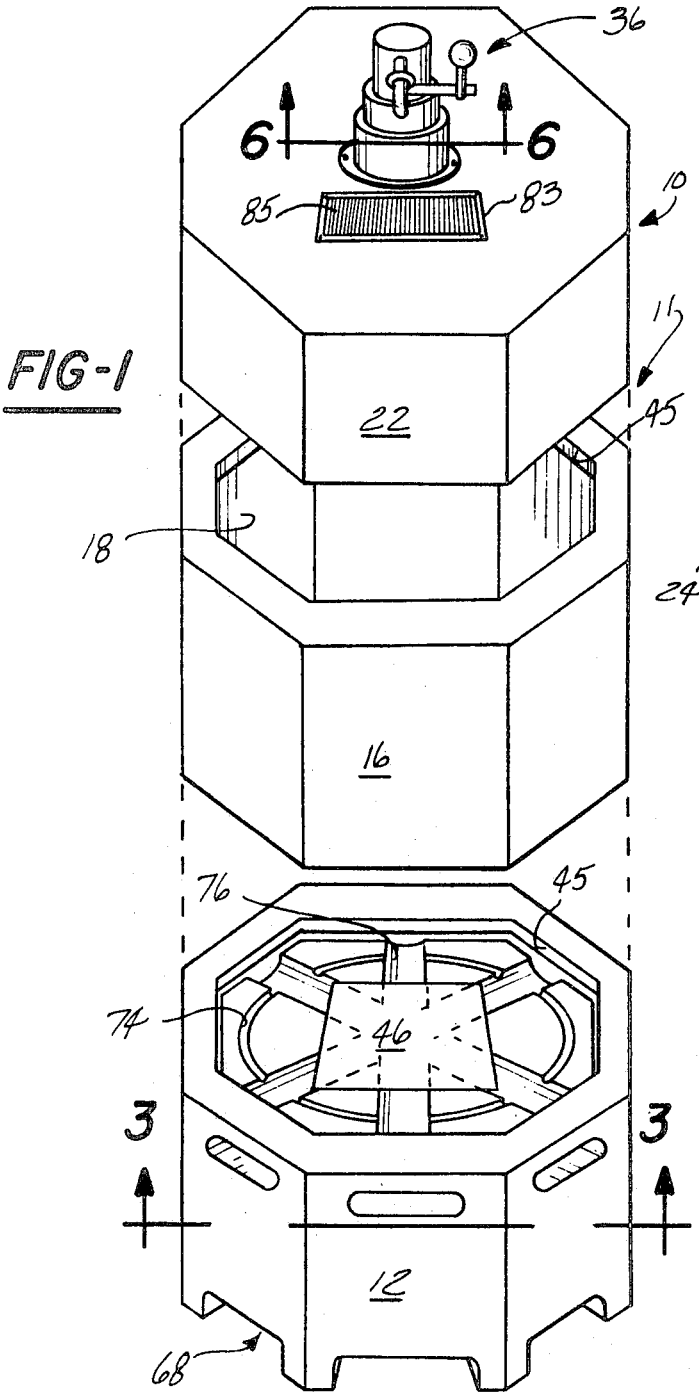
FIG. 1 illustrates an exploded perspective view of the portable modular beverage dispenser of the present invention.

Referring now to the drawing and in particular to FIG. 1 there is illustrated at 10 a preferred embodiment of the present invention in the form of a portable modular beverage dispenser. The beverage dispenser 10 is adapted to provide refrigerated storage for beverage containers such as beer kegs and dispense the beverage as required.

Figure 2:
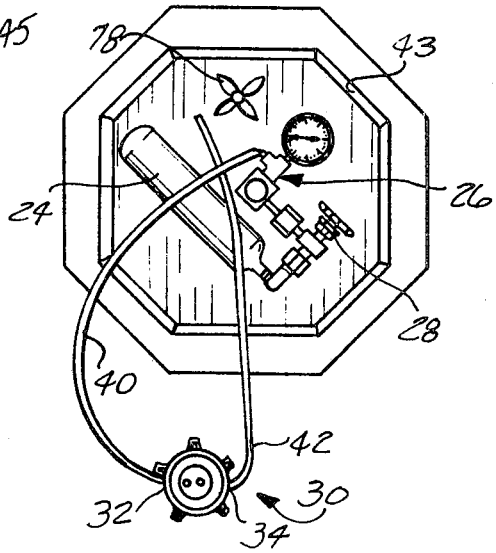
FIG. 2 represents a bottom view of the cover module of the present invention.

The portable beverage dispenser 10 comprises an insulated container 11 which includes a base 12 having a refrigerator unit 14 contained therein. The container 11 further includes a central sleeve module 16 concentrically engageable with the base 12 including a central bore 18 configured to encircle a beverage container 20. A cover module 22 concentrically engageable with the sleeve is employed to enclose the container. As illustrated in FIG. 2 the cover module includes a container of pressurized gas 24, a pressure regulator 26 in communication with the gas container 24, and a shut-off valve 28 interposed the regulator 26 and the gas container 24. The cover module 22 further includes a tapping head 30 which includes a gas inlet 32 for applying regulated gas to the beverage container 20, and a beverage outlet 34 for dispensing beverage. A dispensing tower 36 is provided at the top of the cover module 22 for dispensing beverage upon demand as will be described subsequently in greater detail. A gas conduit 40 extends between the regulator 26 and the gas inlet 32, and a beverage conduit 42 extends between the beverage outlet 34 and the dispensing tower 36. Flanges 43 deployed at a lower end of the cover 22 and the sleeve 16 are configured to snugly engage internal recesses 45 formed at an upper end of the sleeve 16 and the base 12 to align the mating components and provide an air tight seal preventing the escape of refrigerated air from the container.

FIG. 4 of the drawing illustrates the use of a toroidal pressure vessel 24' installed within the cover module 22. The toroidal pressure vessel 24' provides approximately three times as much pressurized gas storage capacity as the conventional pressurized gas container 24 yet fits within the available space. Also, placing the pressure regulator 26 and the shut-off valve 28 within the interior of the toroidal pressure vessel 24' protects these components from damage.

Referring now to FIG. 3 of the drawing, a support plate 44 is disposed at a lower end of the base 12 and positioned to abut a supporting surface such as a floor of a room. An evaporator plate 46 is disposed at the upper end of the base 12 and a plurality of support rods 48 extend between and interconnects the support plate 44 and the evaporator plate 46. A plurality of recessed screws 50 engage a plurality of recessed apertures 52 in the support plate 44 and first threaded apertures 54 in the support rods 48 to affix the support plate 44 to the support rods 48. A plurality of threaded fasteners 56 engage a plurality of apertures (not shown) formed in the evaporator plate 46 aligned with a second plurality of threaded apertures (not shown) formed in the support rods 48 to secure the evaporator plate to the upper end of the support rods. This method of supporting the evaporator plate permits any load imposed upon the evaporator plate 46 to be directly transmitted to the support plate 44 and subsequently to the floor avoiding damage to the refrigeration unit 14.

A central recess 66 formed in the base 12 provides room for the refrigeration unit 14 which is supported by the support plate 44. A plurality of lower recesses 68 formed along a lower edge of the periphery of the base 12 are in communication with the central recess 66. A plurality of upper openings 70 around the periphery of the base 12 are also in communication with the central recess 66 wherein cooling air is allowed to enter the lower recesses 68 and exit from the upper openings 70 providing convection cooling and heat dissipation for a condenser 72 for efficient operation of the refrigeration unit 14.

The central sleeve 16 may be varied in length to accommodate beverage containers of different size. A separable hinge 62 affixed to the sleeve 16 and the cover 22 permits the cover 22 to be hinged away from the top of the beverage container but remain in the proximity thereof thus allowing easy installation of the tapping head 30 to the beverage container. A latch 64 (FIG. 5) positioned opposite the hinge 62 allows the cover 22 to be releasably attached to the sleeve in a closed position.

The base 12 includes at its upper end a container centering circular recess 74 to position and center the beverage container 20. A plurality of diametrical recesses 76 extend across the upper end of the base 12 to expose a substantial portion of the evaporator plate 46 to air circulated therepast thereby improving the efficiency of the refrigeration unit. An electrical fan 78 is optionally provided in the cover 22 or in the refrigeration unit 12 to aid in circulation of the air throughout the container.

FIG. 5 of the drawing illustrates an embodiment of the present invention wherein the insulated container and beverage dispenser is provided with an insulated base 80 replacing the refrigeration unit in the base 12 for a compact low cost beverage dispenser which may be employed when long term storage of the beverages is not required.

Figure 7:
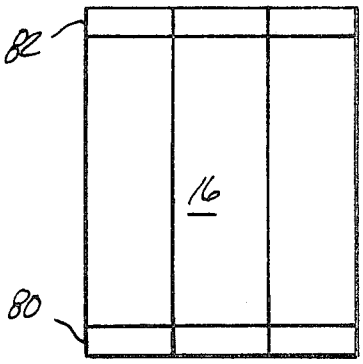
FIG. 7 illustrates an insulated beverage container storage device.

FIG. 7 of the drawing illustrates an embodiment of the present invention wherein an insulated cover 82 is provided having an open lower end engageable with the base 80 for insulated storage of beverage containers or other perishables.

In a preferred embodiment a drain recess 83 is provided at an upper end of the cover 22 directly below the dispensing tower 36 to provide a place for drippings from the tower to accumulate. A grill 85 flush with the upper end of the cover provides a place for resting pitchers and glasses over the recess as they are filled.

In a preferred embodiment a telescoping dispensing tower as illustrated in FIG. 6 is provided. The tower 36' comprises a plurality of telescoping tubes 84 with flanges 86 formed at their lower end to limit the extension of the tower as they abut upper flanges 88 of their mating tube. A lower flange 90 includes a plurality of mounting apertures 92 for mounting the tower 36'. A shut-off valve 93 is mounted to an upper end of the telescoping tower in communication with the interior of the telescoping tubes. A flexible conduit 94 includes one end 96 attached to the shut-off valve 93 and another end 98 attached to the beverage outlet 34 of the tapping head 30. The telescoping tower 36' permits the tower to be compressed for compact shipment and/or storage.

In the preferred embodiment an octagonal cross section is utilized to enable the cooler 10 to fit conveniently in a corner of a room. Preferably the body of the cooler is formed from molded plastic foam such as rigid self skinning Urethane which is light weight and provides excellent insulation for efficient operation.

Figure 8:
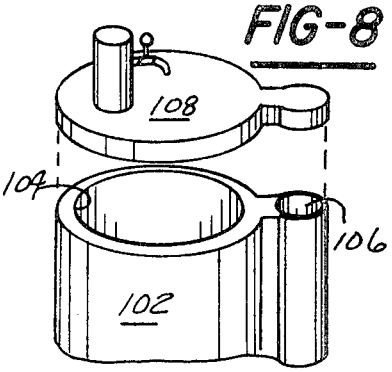
FIG. 8 illustrates an insulated beverage dispenser having a pressure level compartment adjacent the container.

In yet another embodiment of the present invention illustrated in FIG. 8, an insulated vessel 102 is employed having an open top and an enclosed bottom. A central portion 104 is sufficiently large to enclose the beverage container (not shown). A compartment 106 adjacent to and in communication with the central portion 104 is configured to house a pressure vessel (not shown). A cover 108 complementary to the vessel encloses the beverage container and pressure vessel. A dispensing tower 110 or similar device is provided to dispense the beverage in a known manner.

It can thus be seen that the present invention has provided a new and improved portable modular insulated beverage container and dispenser for transporting, storing, and dispensing beverages. The present invention may also be employed for transporting and storing perishable items that need careful refrigeration. The present invention is very economical in design and very economical to operate.

It should be understood by those skilled in the art to which this invention pertains that other forms of the Applicants invention may be had all coming within the spirit of the invention and the scope of the appended claims.

Having thus described our invention what we claim is:

1. A portable modular insulated container comprising:

a base module including refrigeration unit;

a central sleeve module concentrically engageable with the base including a central bore configured to encircle a beverage container;

a cover module concentrically engageable with the sleeve to enclose the container including a container of pressurized gas, a pressure regulator, a shut-off valve interposed the regulator and gas container, a tapping head including a gas inlet for applying regulated gas to the beverage container and a beverage outlet for dispensing beverage, a dispensing tower with a hand operated dispensing valve, a gas conduit extending between the regulator and the gas inlet, and a beverage conduit extending between the beverage outlet and the dispensing tower;

a support plate abutting a supporting surface;

an evaporator plate at an upper end of the base;

a plurality of support rods extending between the support plate and evaporator plate;

a container centering recess formed in the upper end to engage a flange of the beverage container; and a plurality of diametrical recesses formed in the upper end, said diametrical recesses extending below and ending radially outward of the container centering recess to provide air circulation around the evaporator plate.

2. A portable modular insulated container comprising: a base module including a refrigeration unit and having an upper end and a lower end;

a central sleeve module concentrically engageable with the base including a central bore configured to encircle a beverage container;

a cover module concentrically engageable with the sleeve to enclose the container;

a support plate at the lower end abutting a supporting surface;

an evaporator plate at the upper end;

a plurality of support rods extending between the support plate and evaporator plate;

a container centering recess formed in the upper end to engage a flange of the beverage container; and a plurality of radial recesses formed in the upper end, said radial recesses extending across and ending radially outward from the container centering recess to provide air circulation around the evaporator plate.

* * * * *

UNITED STATES PATENT AND TRADEMARK OFFICE

CERTIFICATE OF CORRECTION

PATENT NO. : 4,350,267

DATED : September 21, 1982

INVENTOR(S) : Richard E. Nelson and Thomas J. Starr

It is certified that error appears in the above-identified patent and that said Letters Patent are hereby corrected as shown below:

Column 2, line 57, delete "level" and add -- vessel --.

Signed and Sealed this

*Eighth* Day of *March 1983*

[SEAL]

*Attest:*

GERALD J. MOSSINGHOFF

*Attesting Officer*

*Commissioner of Patents and Trademarks*